US007530470B1

(12) United States Patent
Houser

(10) Patent No.: US 7,530,470 B1
(45) Date of Patent: May 12, 2009

(54) CHILD RESISTANT AEROSOL CAN COVER

(76) Inventor: Kent A. Houser, 1624 Highland Rd., Twinsburg, OH (US) 44087

( * ) Notice: Subject to any disclaimer, the term of this patent is extended or adjusted under 35 U.S.C. 154(b) by 464 days.

(21) Appl. No.: 11/266,728

(22) Filed: Nov. 4, 2005

(51) Int. Cl.
*B65D 41/16* (2006.01)
*B65D 41/18* (2006.01)
*B65D 43/08* (2006.01)

(52) U.S. Cl. ..... 220/780; 220/281; 220/915

(58) Field of Classification Search ..... 220/780, 220/281, 784, 724, 915; 215/330, 224
See application file for complete search history.

(56) References Cited

U.S. PATENT DOCUMENTS 3,802,607 A * 4/1974 Mead ..... 222/182
3,820,683 A * 6/1974 Jasinski ..... 220/784
3,854,622 A * 12/1974 McKirnan ..... 220/784
3,885,715 A * 5/1975 Lowry ..... 222/182
3,934,751 A * 1/1976 Green et al. ..... 220/784
3,964,634 A * 6/1976 Jasinski et al. ..... 220/281
3,995,765 A * 12/1976 Burke ..... 220/281
4,029,231 A * 6/1977 Jonsson ..... 215/256
4,130,220 A * 12/1978 McKirnan ..... 220/284
4,165,014 A * 8/1979 Ruscitti ..... 220/266
5,145,080 A * 9/1992 Imbery, Jr. ..... 215/331
5,806,698 A * 9/1998 Aguirrezabal ..... 215/235
5,915,576 A * 6/1999 Robinson ..... 215/216
5,921,417 A * 7/1999 Mull ..... 215/216
7,100,785 B1 * 9/2006 Suffa ..... 215/330

* cited by examiner

*Primary Examiner*—Anthony D Stashick
*Assistant Examiner*—Niki M Eloshway
(74) *Attorney, Agent, or Firm*—Tarolli, Sundheim, Covell & Tummino LLP

(57) ABSTRACT

A child resistant detachable molded plastic cover member for a cylindrical aerosol can is provided having improved release and storage capability. The cover employs an unperforated outer shell having physical depressions suitably placed on the outer surface to release the cover member.

9 Claims, 3 Drawing Sheets

CHILD RESISTANT AEROSOL CAN COVER

BACKGROUND OF THE INVENTION

This invention relates generally to a detachable molded plastic cover for a cylindrical shaped aerosol can that cannot be readily opened by a child, and more particularly, to significantly improved release means for said cover member.

A wide variety of child resistant detachable molded plastic covers for a cylindrical shaped aerosol can are already known which include various type locking means to avert or at least make more difficult any cover removal by children followed by possible subsequent release of the can contents. Unfortunately, a number of such cover locking means simply require a twisting or turning action to release the can cover and which can be mastered by many children at a very young age. Still other cover or cap locking means while providing various degrees of child resistance go unused or have gained only limited acceptance because of complex constructions often requiring a number of operationally cooperating structural parts. The relative cost of such prior art molded plastic can covers can be economically impractical both in the area of attaching the cover member detachably to the aerosol can as well as the manufacturing costs for such an article. A similar recognition that such overly complicated plastic can covers are generally formed having a one piece integral construction makes it burdensome to mold such articles with conventional injection molding equipment.

Accordingly, it remains desirable to simplify the release means for a molded plastic can cover being employed with a cylindrically shaped pressurized aerosol can so as to be conveniently removable by simple operation as well as replaced in a similar manner for additional discharge of the remaining can contents.

It is another object of the present invention to provide a releasable molded plastic can cover for a cylindrically shaped pressurized aerosol can which includes simplified release means not requiring extensive modification to the injection molding equipment now being employed to form the final article.

Still another important object of the present invention is to further provide such novel molded plastic can cover having an unperforated outer shell to better avert accidental discharge of the can contents during handling or storage of the closed container.

These and further objects of the present invention will become more apparent upon considering the following detailed description of the present invention.

SUMMARY OF THE INVENTION

It has now been discovered that still more effective and simplified release means to detach the present plastic can cover from a cylindrical shaped aerosol can is now provided. More particularly, the present molded plastic can cover is formed with a customary flexible organic polymer in a conventional injection molding press having a cup shape formed with top and side wall surfaces terminating in an open bottom. Said cover member further includes an outer hollow shell enclosing a centrally disposed inner hollow shell and which are physically interconnected together with diametrically opposed single rib elements. Release means for the present cover member consist entirely of diametrically opposed physical depressions formed in the outer shell of the unperforated cover member which can be located at the midpoint of said single interconnecting rib elements. Not having to perforate the cover member in providing the presently improved release means understandably reduces the complexity and costs for the mold cavities being employed to form the present cover construction.

To release the present cover member for discharge of the aerosol can contents simply entails finger pressure applied to the physical depressions provided on the outer side walls of said member and which will be readily apparent to an adult without necessitating printed instructions to be placed on the cover itself. Since young children do not ordinarily possess sufficient finger strength or dexterity needed to remove the present can cover in said manner, the present release means affords greater safety against child exposure to the can contents. Squeezing the can cover for removal in said manner enables the inner shell to become elongated for release of physical engagement between the can and cover member in the otherwise customary manner. Specifically, the inner hollow shell of the present cover member further includes the customary inwardly facing detents which have been joined to depressions formed in the top dispensing end of the can member when said cover member is snapped in place for closure of the can contents. In a preferred embodiment of the present molded plastic can cover for pressurized aerosol cans, said cover member is constructed having a cylindrical inner hollow shell without internal vertically extending reinforcement ribs but with said type reinforcing ribs being included on the inner surface of the outer shell. Another preferred embodiment of the present cover member includes a cylindrical inner shell interrupted with outward facing protuberances joined to both single rib elements interconnecting said inner and outer shells while further having said vertically extending reinforcing ribs being disposed on the inner wall surfaces of both inner and outer hollow shells.

DETAILED DESCRIPTION OF THE PREFERRED EMBODIMENTS

Figure 1:
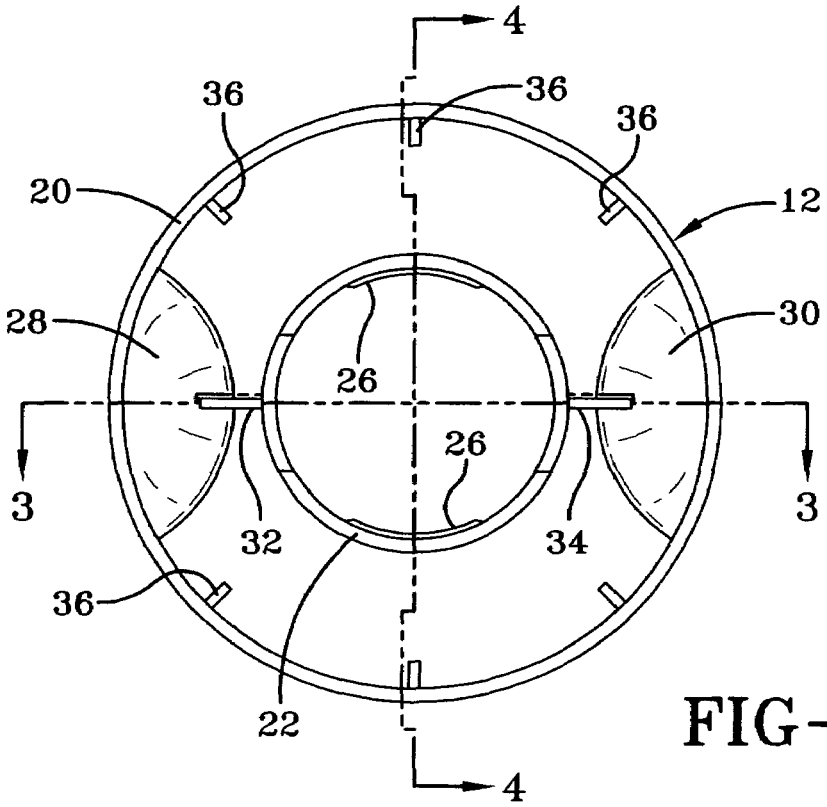
FIG. 1 is a top plan view for a representative molded aerosol can cover according to the present invention.

Referring to the drawings, there is depicted in FIG. 1 a top plan view for a representative molded plastic can cover member 12 of the present invention which is intended to be detachably secured to a customary cylindrical shaped pressurized aerosol can member 10 as later described in followings FIGS. 3-4. As shown in FIG. 1 said cup shaped molded can cover 12 has an outer hollow shell 20 enclosing an inner centrally disposed inner hollow shell 22 which surrounds the dispensing valve of the can member. An inwardly projecting pair of detent elements 26 disposed at the bottom end of inner shell 22 provides locking engagement of the cover member to can 10. Cover member 12 still further includes the simplified release means of the illustrated cover member which consists of diametrically opposed inwardly curved physical depressions 28 and 30 formed on the outer wall surface of shell 20. Said physical depressions are further interconnected to inner shell 22 with single horizontally disposed rib elements 32 and 34, respectively, so that finger pressure by an adult forces the detent elements to open for release of said cover member from engagement. As can be further noted in the present drawing, both physical depressions 28 and 30 are further desirably disposed at the midpoint of the single rib elements connected thereto for maximum finger pressure detachment of the cover member. Optionally provided vertically extending reinforcement ribs 36 are also shown in the present drawing as being included around the inner wall surfaces of outer shell 20.

FIG. 2 is again a top plan view for a different molded plastic can cover 40 of the present invention. As shown, said cup shaped can cover 40 includes an outer unperforated outer hollow shell 42 physically enclosing an inner shell 44 in the above described manner but with said inner shell having a modified inner shell construction enabling greater retraction of the incorporated detent elements. In so doing, the inner hollow shell 44 of the presently modified cover member now further includes outwardly extending protuberances 46 and 48 to physically connect the inner ends of single rib elements 50 and 52, respectively, in joining said inner shell to outer shell 42. Said inner hollow shell 44 of the present cover member again further includes a pair of detent elements 54 disposed on its inner wall surface for release of the cover member in the desired manner upon squeezing the outwardly curved physical depressions 56 and 58 disposed on the outer cover wall. Release of the presently depicted cover member is observed to improve with greater elongation of the inner shell under finger pressure than observed with the preceding cover member described in FIG. 1. As further distinct from said preceding cover member, the presently modified cover member 40 now also includes vertically extending reinforcement ribs 66 disposed on the inner wall surfaces of both inner and outer shell components to increase strength of the covered aerosol can when stored on top of each other in multiple layers.

Figure 3:
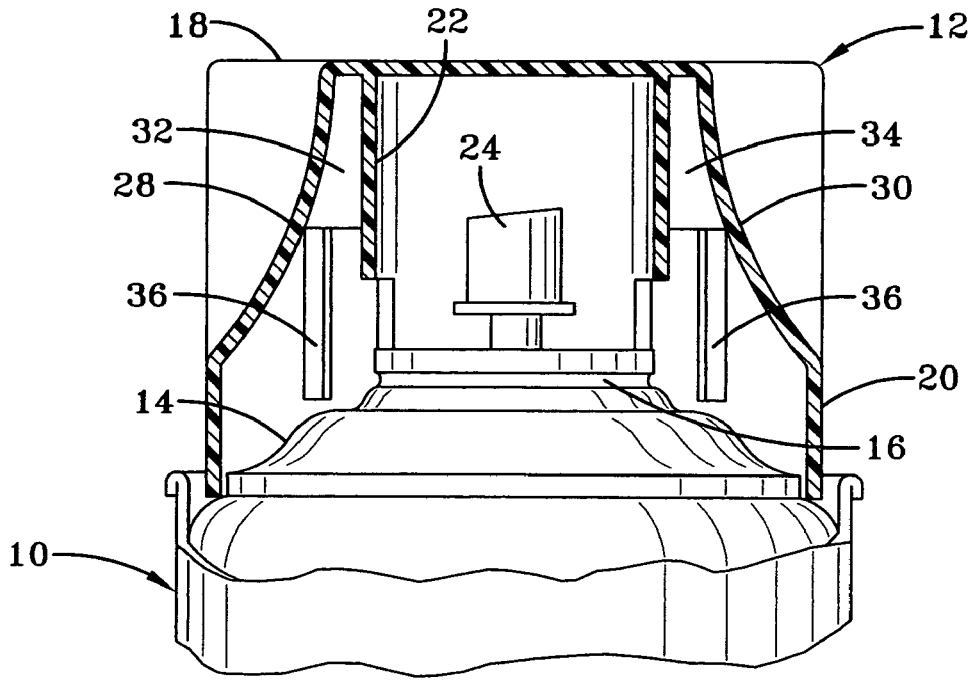
FIG. 3 is a side plan view partially in cross section taken along line 3-3 of FIG. 1.

FIG. 3 is a side plan view partially in cross section depicting the plastic cover member 12 detachably secured to aerosol can member 10 along line 3-3 as shown in said preceding FIG. 1 drawing. As now shown in the present drawing, said plastic cover member 12 is physically secured to a typical pressurized aerosol can 10 (shown only partially) in the previously described manner with said cup shaped cover member being molded with a top flat surface 18 from which extend outer hollow shell 20 and inner hollow shell 22. The inner shell component of said cover member is centrally disposed to physically surround the dispensing valve 24 of the can member. The dome shaped dispensing end 14 of said can member includes a peripheral recess 16 for cover attachment thereto. Physical depressions 28 and 30 provided on the outer surface of outer shell 20 are inwardly curved and are shown to be physically connected to opposite sides of inner shell 22 by means of the single interconnecting rib elements 32 and 34. The vertically extending reinforcement ribs 36 disposed on the inner wall surface of outer shell 20 are also depicted in the present drawing.

Figure 4:
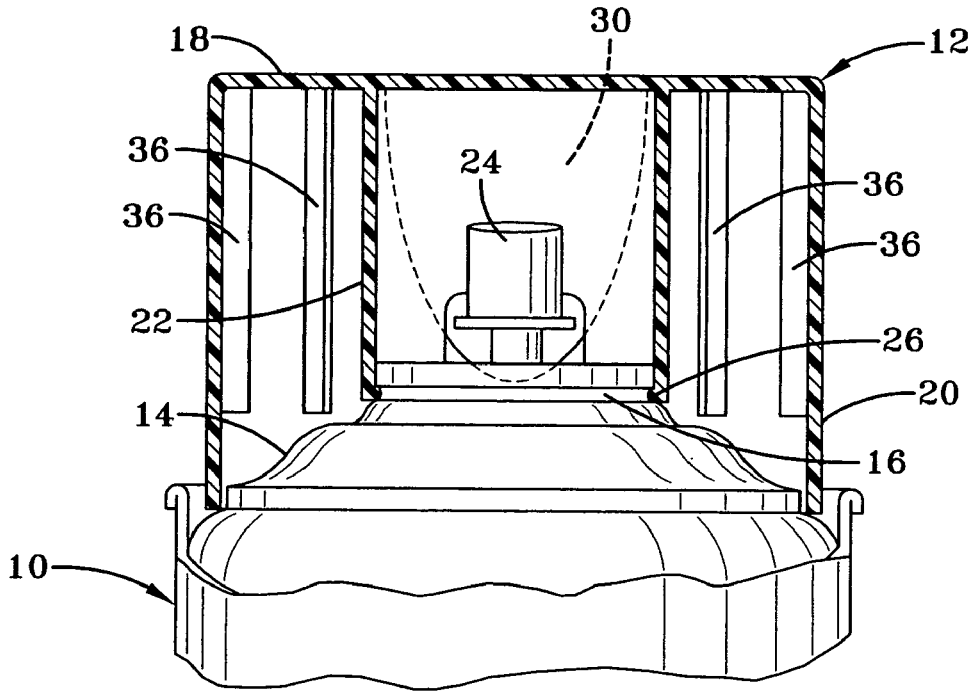
FIG. 4 is another side plan view partially in cross section taken along line 4-4 of FIG. 1.

FIG. 4 is still another side plan view depicting the FIG. 1 cover embodiment 12 along line 4-4 when detachably secured to can member 10. As can be seen in the present drawing, the inwardly projecting detent elements 26 disposed at the bottom end of inner shell 22 provides a locking engagement of said cover member to can 10. It can be further noted in the present drawing that said detent elements 26 are desirably positioned at approximate right angles with respect to both physical depressions 28 and 30 formed on the outer cover shell. Such an arrangement enables said cover member to be released more readily under finger pressure being exerted upon said physical depressions to retract the detent elements.

Figure 2:
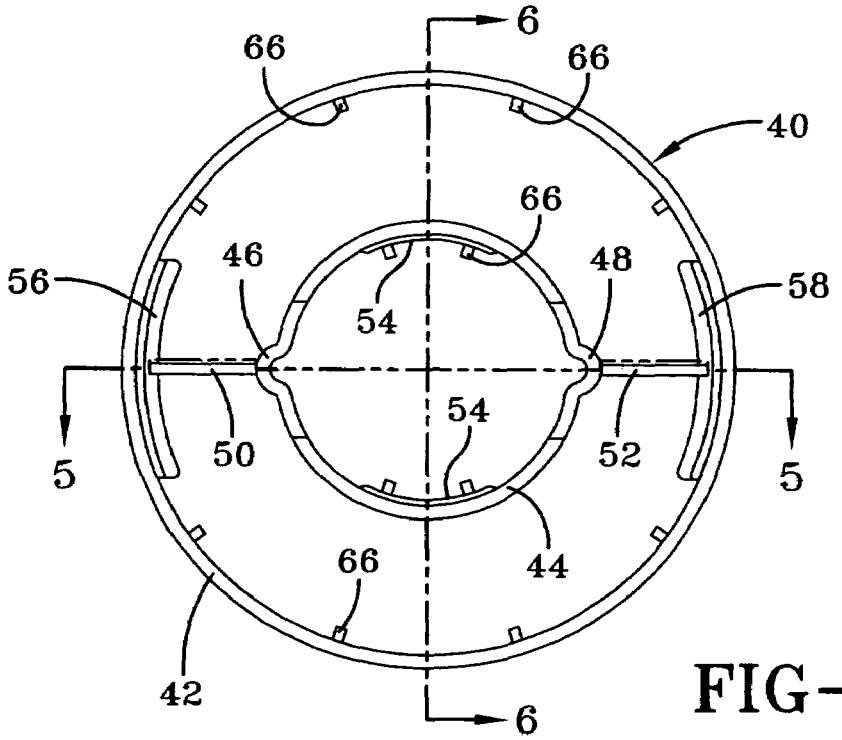
FIG. 2 is a to plan view for a different representative cover member of the present invention.
Figure 5:
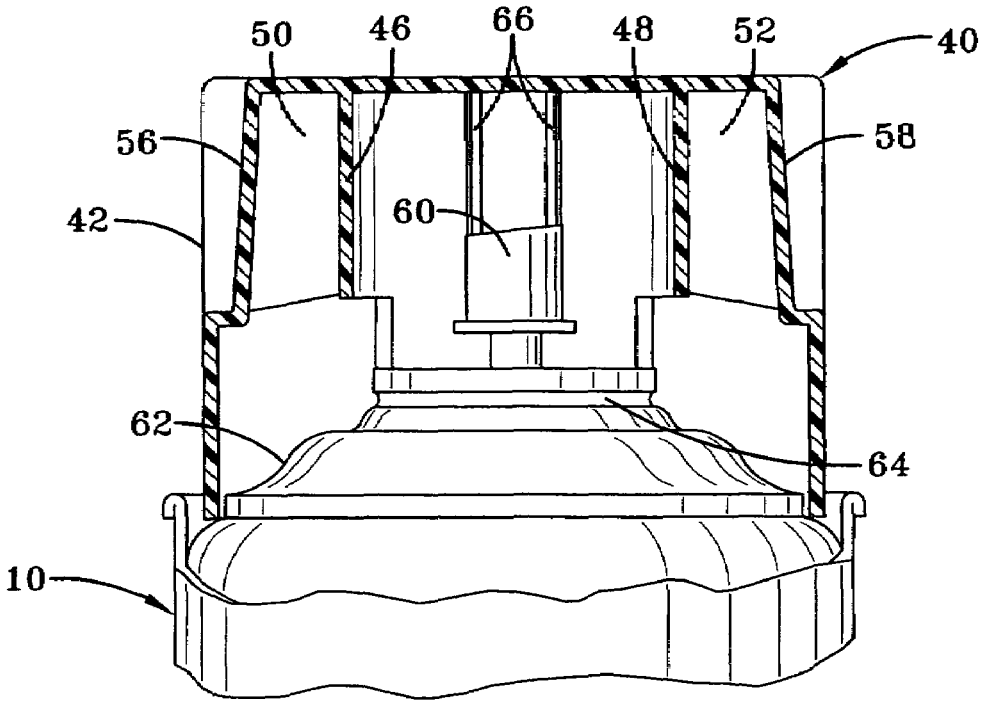
FIG. 5 is a side plan view partially in cross section taken along line 5-5 of FIG. 2.

FIG. 5 represents a side plan view for the FIG. 2 cover embodiment 40 when again attached to the aerosol can member 10. Said partial cross section of the assembled can and cover is taken along line 5-5 of the preceding FIG. 2 drawing with said cover member again including inner and outer shell components. As herein depicted, outwardly projecting protuberances 46 and 48 provided on the inner shell component physically connect the inner end of single rib elements 50 and 52, respectively, joining said inner shell component to the outer shell component. The outer ends of said single rib elements are joined to physical depressions 56 and 58 again formed on the outer shell of said cover member. Release of the presently modified can cover is observed to improve with a greater elongation of the inner shell component under finger pressure. As can be further seen in the present drawing, said modified cover member 40 again physically surrounds the dispensing valve 60 of can member 10 which likewise includes a dome shaped dispensing end 62 together with a peripheral recess 64 for cover attachment thereto. Vertical reinforcement ribs 66 are also depicted in the present drawing as being provided on the inner wall surfaces of both depicted inner and outer shell components for additional strength.

Figure 6:
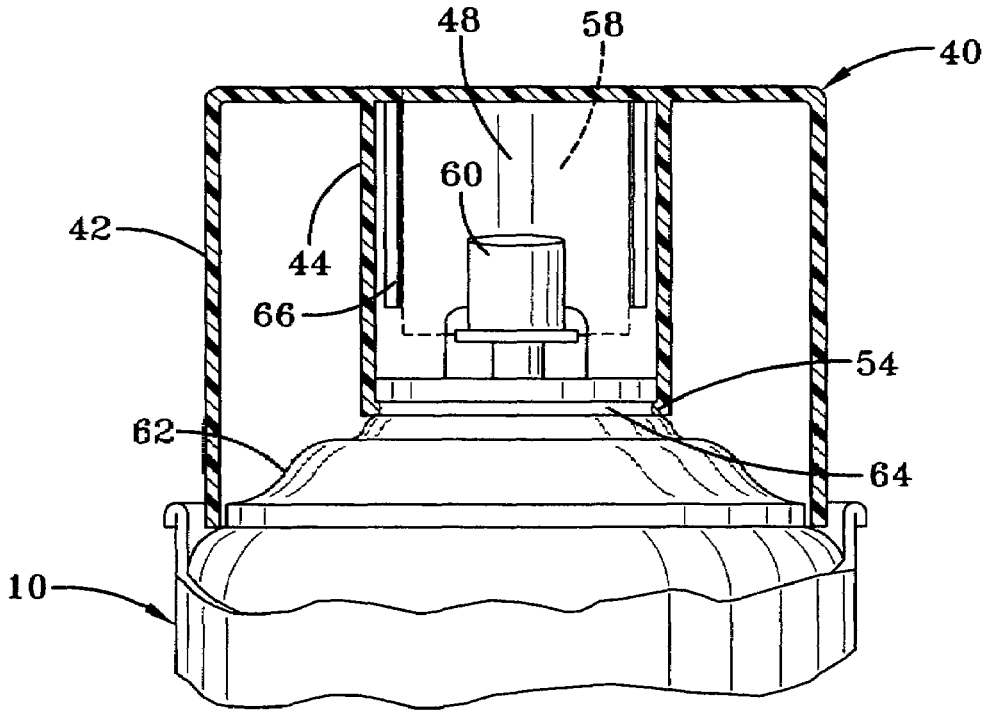
FIG. 6 is another side plan view partially in cross section taken along line 6-6 of FIG. 2.

Remaining FIG. 6 is an added plan view of the presently described FIG. 2 cover embodiment taken along line 6-6 of said preceding drawing. Accordingly, said partially depicted can member 10 has detachably secured thereto said cover member 40 in the previously described manner. Said molded plastic cover member in the assembled can configuration again includes an outer hollow shell 42 enclosing an inner shell component 44 having outwardly curved physically depressions 56 and 58 formed on opposite sides of the outer shell component. As herein depicted, a single outwardly extending protuberance 48 provided in said inner shell component connects the inner and outer shell components together with single rib elements not visible in the present sectional drawing. The pair of detent elements 54 further included in the illustrated cover member can again be seen to be disposed at approximate right angles relative to the physical depressions 56 and 58 formed on the outer shell component. Multiple reinforcement ribs 66 provided to the inner shell of the depicted cover member are also depicted in the present sectional drawing.

It will be apparent from the foregoing description that the above described child resistant molded aerosol can cover affords improved release and storage capability along with greater ease of manufacture. It is contemplated that enhancement of the disclosed release means for said cover member can possibly still further be improved, however, utilizing additional means for detachably securing the cover member to the dispensing aerosol container. Likewise, substituting other flexible polymer materials for the conventional synthetic thermoplastic polymers now being formed with injection molding equipment is also contemplated. Consequently, it is intended to limit the present invention only by the scope of the appended claims.

The invention claimed is:

1. A child resistant cylindrical aerosol can cover formed with a flexible molded one piece polymer member having an unperforated outer hollow shell enclosing a hollow inner shell which are always and continuously physically interconnected together with single diametrically opposed radially extending rib elements, said cover member further having release means consisting essentially of physical depressions disposed on the exterior surface of the outer shell which physically engage the outer end of each rib element.

2. The cover member of claim 1 having a cylindrical cup shape formed with top and side wall surfaces terminating in an open bottom.

3. The cover member of claim 1 wherein engagement of each depression with the outer end of each rib element occurs approximately at the midpoint of said depression.

4. The cover member of claim 2 wherein said depressions extend from the top wall surface of said cover member and have a curved shape.

5. The cover member of claim 4 wherein said depressions are convex in shape.

6. The cover member of claim 2 wherein the inner shell of said cover member further includes inwardly projecting bottom detent elements for locking engagement of said cover member to a cylindrical shaped aerosol can.

7. The cover member of claim 1 wherein said cover member is formed with a synthetic thermoplastic polymer material.

8. A pressurized aerosol can having a cylindrical shape with a centrally disposed valve means at one end enabling detachable physical engagement thereat of a replaceable cylindrical flexible molded plastic cover member, the cover member having a cup shape formed with top and side wall surfaces terminating in an open bottom to include an unperforated outer hollow cylindrical shell enclosing an inner hollow cylindrical shell surrounding the dispensing valve means and with said inner hollow shell further including inwardly projecting bottom detent elements for locking engagement of said cover member to said can member, said cover member further having release means consisting essentially of physical depressions disposed on the outer shell of said cover member while being always and continuously physically interconnected to the inner shell of said cover member with single radially extending rib elements.

9. The cover member of claim 8 wherein the inner hollow shell further includes outwardly extending protuberances physically connecting the inner ends of both single rib elements to said inner shell.

* * * * *